United States Patent [19]

Mohr

[11] Patent Number: 4,761,527

[45] Date of Patent: Aug. 2, 1988

[54] MAGNETIC FLUX INDUCTION HEATING

[76] Inventor: Glenn R. Mohr, P.O. Box 52, Linthicum, Md. 21090

[21] Appl. No.: 784,499

[22] Filed: Oct. 4, 1985

[51] Int. Cl.[4] ..... H05B 5/08

[52] U.S. Cl. ..... 219/10.41; 219/10.43; 219/10.77; 219/10.79; 219/10.49

[58] Field of Search ..... 219/10.41, 10.49 R, 219/10.43, 10.77, 10.79

[56] References Cited

U.S. PATENT DOCUMENTS

| | | | |
|---|---|---|---|
| 2,448,009 | 10/1948 | Baker | 219/10.41 |
| 2,902,572 | 3/1957 | Lackner et al. | 219/10.41 |
| 2,912,552 | 1/1957 | Baermann | 219/10.79 |
| 3,041,434 | 6/1958 | Alf | 219/10.41 |
| 3,272,956 | 9/1966 | Baermann | 219/10.49 |
| 3,965,321 | 6/1976 | Brinkman | 219/10.41 |
| 4,481,397 | 11/1984 | Maurice et al. | 219/10.79 |

*Primary Examiner*—A. D. Pellinen
*Assistant Examiner*—Leon K. Fuller
*Attorney, Agent, or Firm*—Charles E. Brown; Charles A. Brown

[57] ABSTRACT

This relates to the induction heating of metal shapes and coils of metal strip wherein the element to be heated functions as a shorted out armature of a D.C. generator. Either the metal shape to be heated or field forming magnets are moved relative to each other wherein the metal shape cuts the flux field to effect an induced generation of electricity within the shape. The frequency of the induced current is such wherein the electrical energy is induced into the metal shape on the order of one third of the thickness of that shape wherein a most efficient conduction of the heat from the electrical energy is effected with a minimum heat loss to the atmosphere. The voltage involved is low while there is a very high amperance. The frequency of the induced current will normally be on the order of one to ten hertz and less than sixty hertz. The relative movement between the field and the shape to be heated may be rotary or linear.

26 Claims, 3 Drawing Sheets

FIG.7A
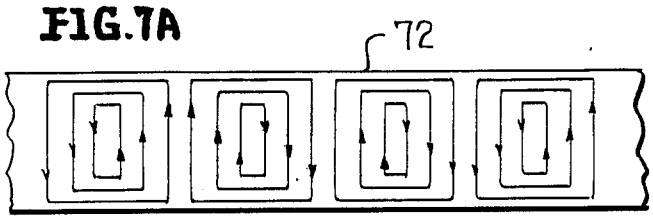
FIG.7B
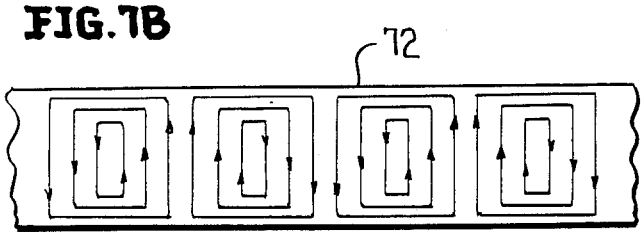
FIG.8
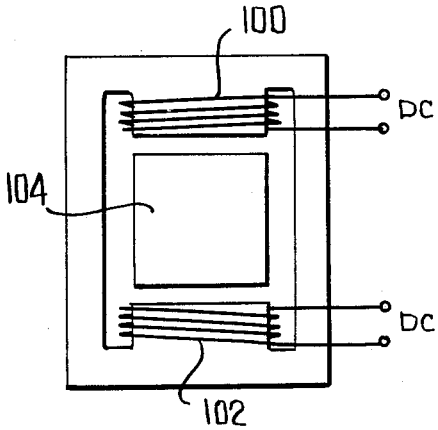
FIG.9
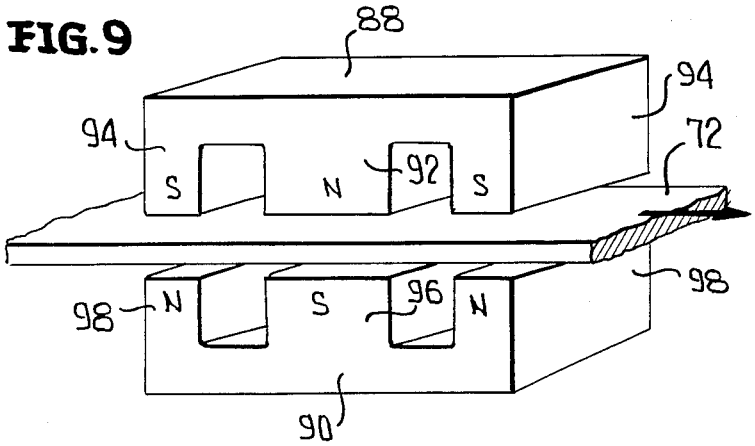
FIG.10
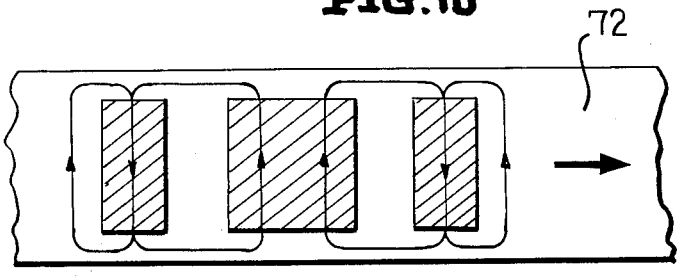
FIG.11
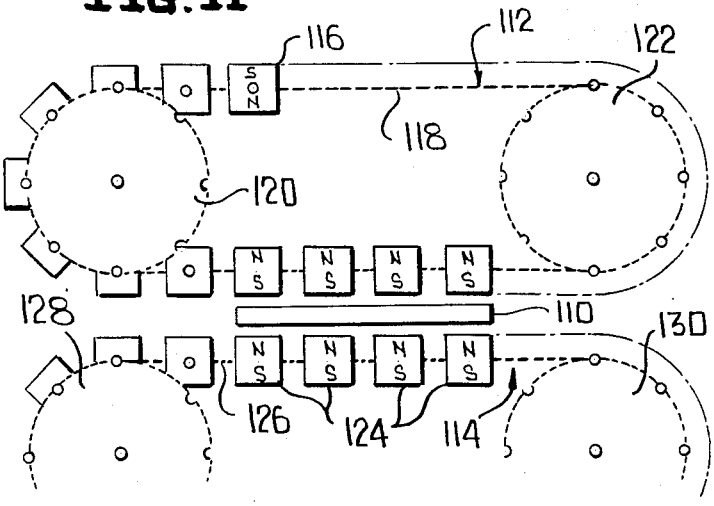
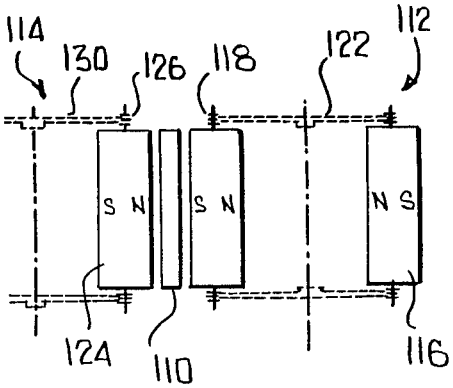
FIG.12

MAGNETIC FLUX INDUCTION HEATING

This invention relates in general to new and useful improvements in the heating of metal, and more particularly to heating of metal bars, strips and sheets utilizing electrical energy.

In accordance with this invention, the piece to be heated is the armature of a generator which generates D.C. current. The rate at which the armature cuts the flux of a magnetic field is equivalent to a generator which generates A.C. current except for speed. A two pole generator rotates at 3600 r.p.m. to generate 60 hertz. This invention is concerned with generating D.C. current so the current will be inversely proportional to resistance for a given voltage. Small workpieces may have a relative movement equivalent to the rotation at speeds up to 900 r.p.m. which is equivalent to 15 hertz. Large pieces will move at a rate equivalent to 60 r.p.m. and less which is equivalent to one hertz or a fraction of a hertz.

In order to generate a voltage, $d\phi/dt$ will effect the depth of current penetration and will confine the current under the pole pieces in the internal circuit within the armature, and the current will be D.C. in the circuit outside of the pole pieces.

This invention particularly relates to a low impedance and low voltage, but high current induced into the workpiece. Induced voltages are seldom over 40 volts and currents can be 100,000 amps and higher.

Further, in accordance with this invention, the pole pieces are large to generate a driving voltage at low speed with the poles being relatively low in number and spaced far apart to allow large cross sections for the current to flow. In accordance with the invention, normally only one or two sets of poles are utilized because large horsepower is required to obtain the necessary relative movement to provide the great heat required to heat large billets and the required torque increases as speed decreases.

In addition to work performed in the 1930's by R. M. Baker of the Westinghouse Research Laboratories, applicant's attention has been directed to the patent to Baermann U.S. Pat. No. 2,912,552. While the Baermann's patent does teach the use of relatively moving magnets and electromagnets to induce electrical energy and thus heat workpieces, the large number of separate fields set up by the magnets and electromagnets, coupled with the high speed of rotation, provide very inefficient operation and generally high frequencies with the result that the electrical energy induced into the workpieces is induced primarily along the surface. Surface heating of articles results in a very inefficient heating in that great heat losses due to convection exist while very small fractions of the induced heat pass into the interior of the workpiece by conduction.

With the above and other objects in view that will hereinafter appear, the nature of the invention will be more clearly understood by reference to the following detailed description, the appended claims, and the several views illustrated in the accompanying drawings.

IN THE DRAWINGS

FIGS. 7A and 7B are schematic views showing the path of flow of current induced into the metal strip with the apparatus of FIG. 5.

FIG. 8 is an end elevational view of a slightly modified form of heating apparatus for accommodating a billet or slab.

FIG. 9 is a perspective view of a further apparatus for heating a moving slab.

FIG. 10 is a schematic view showing the relationship of the poles of the heating apparatus with respect to the slab of FIG. 9 and the direction of induced current flow.

FIG. 11 is a top plan view of an apparatus for heating a stationary plate.

FIG. 12 is an end elevational view of the apparatus of FIG. 11.

Before considering the specifics of the invention, reference is made to a conventional D.C. generator wherein the armature is rotated and a load is connected between the two segments of the commutator of the armature. Under these conditions, one would observe the following:

1. When the plane of the armature is parallel to the field, maximum voltage is generated.
2. When the plane of the armature is at 90° to the field, no voltage is generated.
3. As the armature rotates from 0° to 180°, a positive voltage is generated.
4. As the armature rotates from 180° to 360°, the generator voltage is of the opposite polarity.
5. Due to the commutator, the voltage in the internal circuit is D.C.
6. If the commutator is shorted but there is maximum current flowing in the coil of the armature, the voltage generated under the poles are equal and of opposite polarity and add in series.

Figure 1:
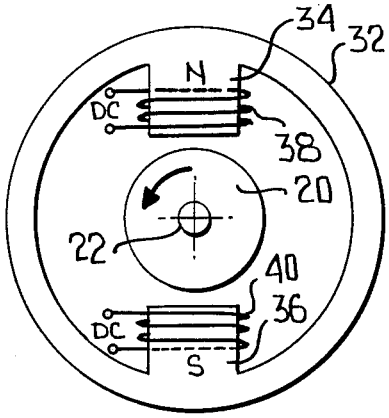
FIG. 1 is a schematic elevational view of an example of the invention wherein a solid cylindrical ingot is being heated in accordance with the invention.

In accordance with this invention, and as is specifically shown in FIG. 1, if one replaces the rotating coil type armature of a conventional D.C. generator with a solid metal cylinder, the voltage generated and the current flow is entirely different:

1. The voltage generated is proportional to the speed of rotation and the angle of cutting the flux and the flux density.

2. The speed of rotation is greatest at the surface and zero at the center.

3. The angle of cutting is greatest under the center of the poles and zero at the sides of the cylinder.

4. According to Fleming's right hand rule, the current flow is at 90° to the direction of rotation and the direction of the flux.

5. From 4 it would indicate that there is not current at the center or sides of the cylinder and maximum current under the poles. The current under the North pole will be in the opposite direction to the current under the South pole. Since the surface of the cylinder forms a closed loop, the voltage under the North pole adds to the voltage under the South pole and the current flowing is proportional to the sum of the two voltages.

Since the cylinder is a metal and an electric conductor, it would seem the voltage under the North pole and the voltage under the South pole would interfere with each other. The reason they do not interfere is $$\text{depth of current penetration} = 1.98\sqrt{\frac{P}{uf}}$$

Where

P=the resistivity of the metal in micro ohm cms.

u=the permeability of the metal.

f=the frequency.

f=r.p.s.×(P/2)

Where r.p.s.=revolutions per second

P=poles f=frequency.

Assume the metal cylinder rotates at 120 r.p.m.=2 r.p.s.

The frequency=2×P/2=2 hertz.

For high resistivity metals, small billets must be heated at high speed. On the other hand, large billets can be heated at low speed or low frequency as in accordance with this invention.

To calculate the power into a billet one must determine where the current flows and the voltage is generated. The voltage generated depends on the area of the poles, the flux density and the frequency.

The resistance of the current circuit depends on the resistivity of the metal to be heated, the area of the current path and the length of the current path. Area and length to be in square cm. and cms.

Assume one wants to heat an aluminum billet 12" diameter × 120" long from 70° F. to 850 degrees F. in 30 minutes:

Weight of billet=$6^2\times\pi\times120\times0.1$=13157 pounds

Power required=17.6×specific heat X lbs. per min. X temperature rise °F.

Power required=17.6×0.214×438.6×780=1,288,218 watts.

Assume 80% efficiency.

Total power=1,618,522 watts.

Make the pole pieces 6" wide×112" long to allow end currents. Area of poles=6×112=672 square inches.

Assume flux density of 30,000 lines per inch squared.

Total flux=672×30,000=20,160,000 lines.

Assume 600 RPM=10 hertz.

$$\begin{aligned}\text{Voltage generated} &= 4.44\,fN\,\phi\,\max\times10^{-8}\\ &= 4.44\times10\times1\times20{,}160{,}000\times10^{-8}\\ &= 8.95\text{ volts}\end{aligned}$$

$$\text{Depth of current penetration} = 1.98\sqrt{\frac{6.3}{10}} = 1.57\text{ inch}$$

$$\begin{aligned}\text{Area of current path under poles} &= 6\times1.57\text{ inches.}\\ &= 9.43\text{ sq. inches}\\ &= 60.8\text{ sq. cm.}\end{aligned}$$

$$\text{Length of path} = 2\times120\times2.54 = 609.6\text{ cm.}$$

$$\text{Resistance} = \frac{6.3\times609.6\times10^{-6}}{60.8} = 63.17\times10^{-6}\text{ ohms.}$$

$$\text{Current flowing} = \frac{8.95}{63.17}\times10^{6} = 141{,}700\text{ amps.}$$

$$\text{Power} = 141{,}700\times8.95 = 1{,}268{,}215\text{ watts.}$$

This is more than 2× the power required. Therefore one can either reduce the flux density or reduce the speed. The better way is to reduce the flux density, this will reduce excitation and keep the torque at a minimum.

The above shows an induction heating system that is simple to build and operate.

By changing D.C. excitation and speed, billets of many metals can be heated with the same equipment. This is a deep heat which can be controlled by controlling the speed of rotation.

In accordance with the heating process of this application, which is designated by the letters MRX, heating is effected by moving the workpiece in a D.C. field. Although the field is D.C., there is a frequency associated with the heating system with the system in reality being an alternator. In such a system, it does not matter whether the field remains stationary and the armature moves or vice versa.

Reference is now made to the drawings in detail wherein in FIG. 1 there is illustrated a solid cylindrical billet 20 which is to be heated. The billet 20 is carried by a shaft 22 which is rotatably journalled in bearings 24 carried by end pieces 26 of a frame, generally identified by the numeral 28. The shaft 22 is driven by a suitable motor 30 which may either be an electric motor or an internal combustion engine.

In the illustrated embodiment of the invention, the frame 28 includes a cylindrical main frame member 32 which carries a pair of elongated poles 34, 36 which are disposed in opposed relation. The pole 34 is provided with a coil 38 while the pole 36 is provided with a coil 40. The coils 38 and 40 are connected to a D.C. power source.

It is to be noted that the poles 34, 36 are elongated and extend slightly less than the full length of the solid cylinder 20 to prevent overheating of the ends.

Figure 2:
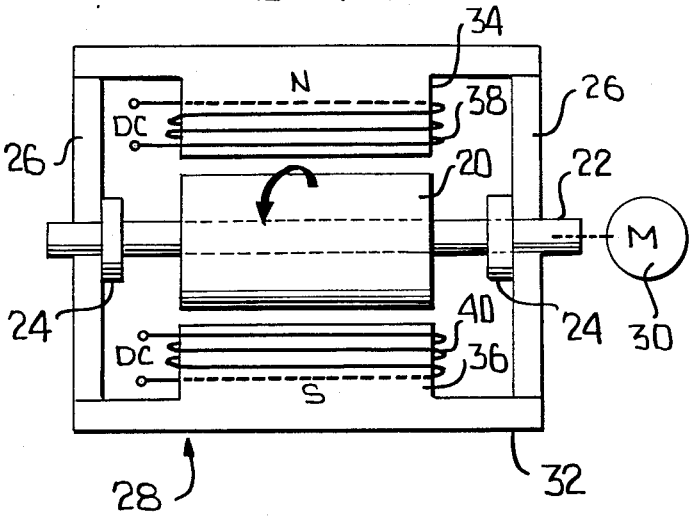
FIG. 2 is a vertical sectional view generally through the apparatus of FIG. 1 and shows further details of the heating apparatus.

In FIGS. 1 and 2, the solid cylindrical member or billet 20 is rotated between the North and South poles 34, 36 of a "U" magnet. According to Fleming's right hand rule, the current flows under the North pole to the end of the billet, crosses over at the end of the billet and returns under the South pole, then across the near end of the billet. There is a closed loop of current. The width of the current path is equal to the pole width and the depth of the current is dependent on the metal and the speed of rotation.

The depth of penetration can be calculated by the following formula:

$$\text{Depth of penetration} = 1.98\sqrt{\frac{P}{uf}}$$

P=the resistivity of the metal in micro ohm cm.
u=permeability
f=frequency

Assume an aluminum billet, P=4.5 micro ohm cm. average over temperature range. RPM=600 f=10 hertz.

The resistance of the current path can now be found.

Assume the flux density is 30,000 lines per square inch and the area of the poles is 672 square inches. Now one can calculate the voltage from the voltage equation.

$$E=4.44\ fN\ \phi max\times 10^{-8}$$

$E$=voltage $f$=*frequency*

$N$=no. of turns $\phi$ max=total flux 4.44 assumes sinsuoidal voltage. $10^{-8}$ converts flux to volts.

The outstanding feature of MRX is that the voltage is very low, seldom no more than 40 volts, and the current is very high. It ranges from 100,000 amps to more than 1,000,000 amps depending on the size of the billet. The resistance of the current path is very small depending on area of current path and length of current path.

The energy for heating is supplied by the prime mover and large motors are usually more than 90% efficient. The losses in the billet are radiation. The other loss is excitation and this varies from 20% on small billets and 5% on large billets.

Figure 3:
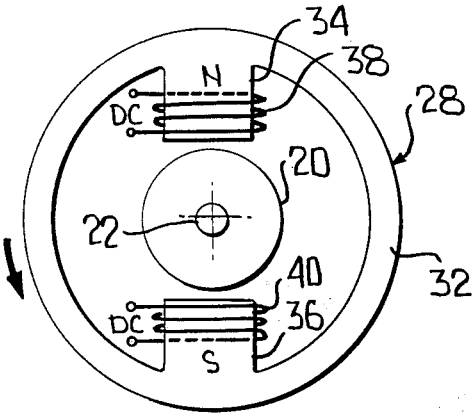
FIG. 3 is a schematic end elevational view similar to FIG. 1, but wherein the ingot being heated is stationary and the field coils are being rotated.

Reference is now made to FIG. 3 wherein the cylindrical billet 20 remains stationary while supported by the shaft 22. On the other hand, the frame 28 is rotated as is indicated by the arrow. The net result is the same.

Figure 4:
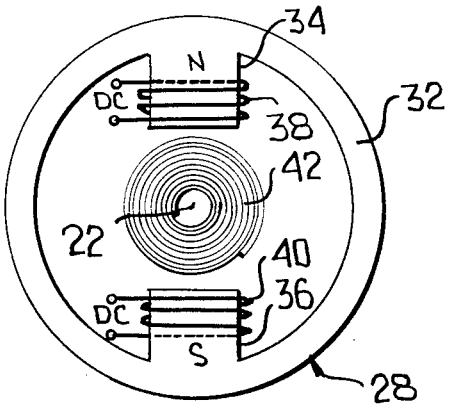
FIG. 4 is another schematic end elevational view similar to FIG. 1, but wherein in lieu of a solid ingot being heated, there is provided a coil of a thin sheet metal web.

On the other hand, with reference to FIG. 4, it will be seen that the billet 20 has been replaced by a coil of a thin metal strip with the coil being generally identified by the numeral 42. The coil 42, like the billet 20, functions as an armature and permits the heating of the metal of coil stock in an efficient manner.

Figure 14:
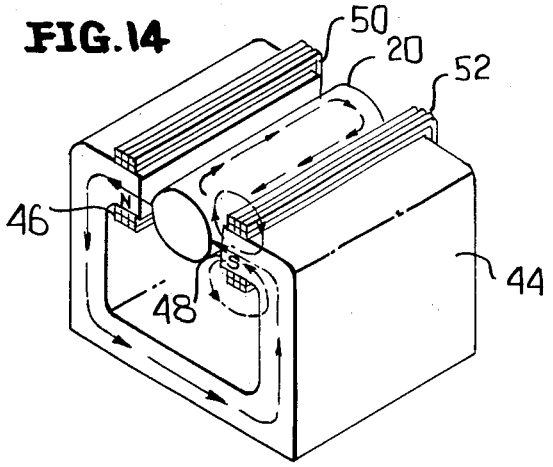
FIG. 14 is a top perspective view of a commercial embodiment of the apparatus of FIG. 1.

Reference is now made to FIG. 14 wherein there is illustrated a modification of the apparatus of FIGS. 1 and 2. In lieu of the double "U" frame, for heavy billets, a heavy true U-shaped frame, such as the frame 44 of FIG. 14 may be utilized. Opposite ends 46, 48 of the frame form the poles and have coils 50, 52, respectively, wound thereabout. The billet 20 or a coil, such as the coil 42, will be mounted for rotation between the opposing poles 46, 48.

Figure 13:
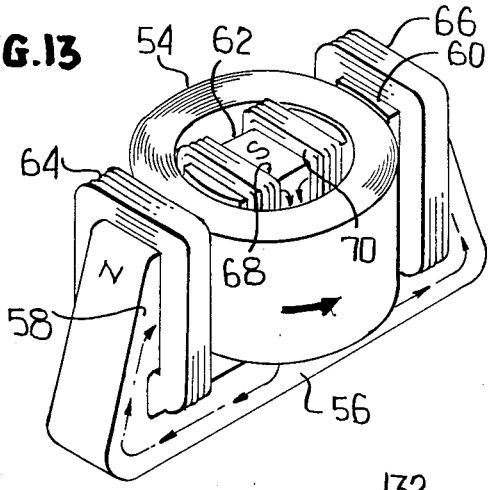
FIG. 13 is a top perspective view of an apparatus for particularly heating an annular member such as a coil of metal strip.

Reference is now made to FIG. 13 wherein there is illustrated specific equipment particularly adapted for heating large diameter annular members 54. The annular members 54 may well be large diameter coils of metal strip. In this accordance with this embodiment of the invention, there is provided a heavy frame 56 which is generally U-shaped and has opposite ends 58, 60 in opposed relation. The frame 56 also carries a central pole 62. The ends 58, 60 will constitute North poles and the center pole 62 will be a South pole. The poles 58, 60 will be provided with coils 64, 66, respectively, while the pole 62 will be provided with two coils 68, 70.

It is to be understood that the annular member 54 will be suitably mounted on frame 56 for rotation about a fixed axis and will be driven in any desired manner.

Figure 5:
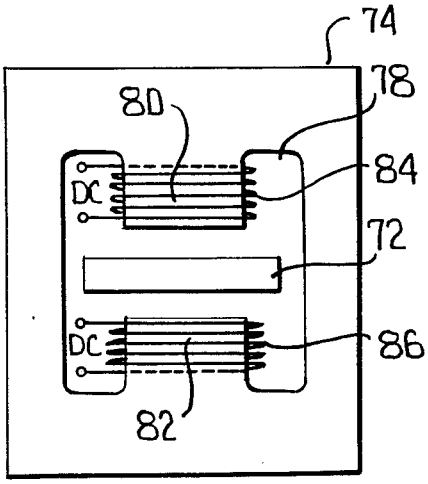
FIG. 5 is an end elevational view of an apparatus for heating a thick metal strip.
Figure 6:
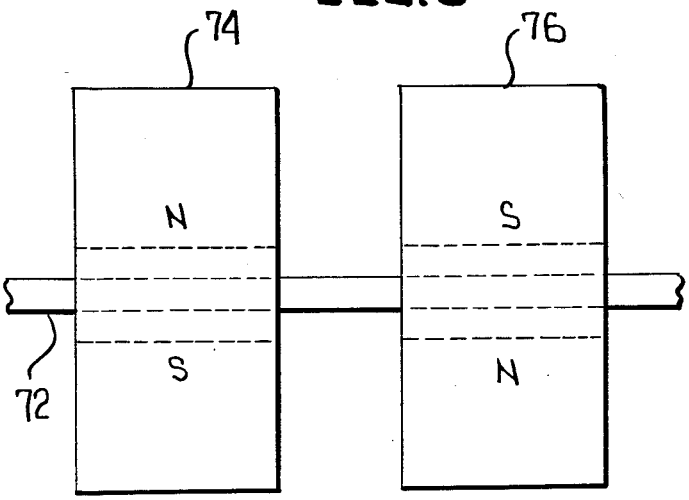
FIG. 6 is a side elevational view of the apparatus of FIG. 5 and shows the individual coil units spaced along the path of the strip.

Referring now to FIGS. 5 and 6, it will be seen that there is illustrated an elongated, relatively thick, strip 72 which passes through a plurality of electromagnets 74, 76. Each electromagnet 74, 76 is in the form of a metal block, which may be of a laminated construction, and which has a generally H-shaped opening 78 therethrough to define a pair of opposed pole pieces 80, 82. The pole pieces 80, 82 have associated therewith coils 84, 86, respectively.

The electromagnet 76 will be of a like construction.

Assuming that the metal strip or slab 72 passes through a single magnet, using Fleming's right hand rule with the North pole on top and the South pole below, and the strip moves from left to right, as viewed in FIG. 6, a voltage is induced across the strip from right to left looking down on the strip.

Due to the induced voltage, the current flows under the magnet, across the strip and divides; half returns to the right side of the strip ahead of the magnet and half returns to the right side through the strip as it leaves the magnet. This is shown in the first part of FIG. 7A. The current flow on the bottom of the strip or slab 72 is shown in FIG. 7B.

As long as the strip or slab moves in one direction, the current flows in one direction as described. The polarity of the current is reversed on the underside of the strip or slab as shown. This is like a homopolar generator except current can flow without brushes. A change in the rate of movement of the strip or slab changes the magnitude of the voltage. This is D.C. heating by induction as long as the strip moves in one direction.

When a second magnet is added, such as the magnet 76 in FIG. 6, there are several arrangements.

1. If the magnets are of the same polarity, it is better to keep them separated far enough so they will load evenly. If they are close together, they operate in parallel between the magnets. Since their voltages are equal the only increase in loading is after the second magnet. If the magnets are widely separated the two magnets will put equal amounts of power into the strip.

2. If the magnets are of opposite polarity the action is different.

a. When the magnets are far apart they load evenly.

b. As the magnets are moved toward each other, there comes a point where the voltages between the magnets oppose each other and the loading.

c. As the magnets are moved still closer together, there comes a point where they act like a rotating machine and the two voltages are in series and the power input to the strip is four times the power on the downstream side of the first magnet.

Also note there is a frequency. The speed of movement of the strip and the width of the magnet and their spacing act to produce a frequency. In order to generate a voltage there must be a change in flux with respect to time $d\phi/dt$. The magnitude of that voltage depends on $d\phi/dt$ and this sets the depth of penetration. In the case of MRX, the size of the magnet in the direction of travel is chosen with strip speed in mind so that the desired depth of penetration is produced.

Assume each magnet is 4 feet wide in the direction of travel and they are 4 feet apart, then 1 hertz=8 feet. If the strip moves 2 feet per second, the frequency=0.25 hertz. At 1 fps the frequency=0.125 hertz.

At this time it is pointed out that it is immaterial as to whether the strip or slab moves and the magnets are stationary or vice versa.

If the mass of the strip or slab to be heated is larger than the mass of the magnets, it may be more desirable to move the magnets and let the strip or slab remain stationary. If the magnets are reciprocated, upon reversal of movement, the magnets can be demagnetized to reduce peak power while changing direction.

If desired, the magnets can be of the structure shown in FIG. 9 wherein there is an upper frame 88 and a lower frame 90. The upper frame 88 will be provided with a large central North pole 92 and two smaller end South poles 94. The lower frame 90 will be of a reverse construction with a large central South pole 96 and smaller end North poles 98. The poles of the two magnets will, of course, be provided with suitable coils.

Since the slab or strip 72 to be heated is elongated and thus considered continuous, and the polarity of the center pole of each magnet is opposite to the first and last pole, the voltage for the second and third current loop is two times the voltage for the first and last current loop as is shown in the schematic illustration of FIG. 10. The power into the strip or slab 72 is increased by the increased voltage.

It is to be understood that more sections could be added to the frames 88, 90 to obtain more heating. However, there comes a time when the weight of the magnet becomes too heavy for good handling and it may be desirable to reciprocate the magnets as opposed to moving the strip or slab because as the strip or slab heats, the tensile strength thereof decreases thus requiring extra drive rolls to be added to distribute the load of the strip or slab and keep loading on the strip or slab below the yield point.

While specific reference has been made to the heating of thick strips or slabs, it is to be understood that with a slight modification, the magnets 74, 76, may be utilized for heating thick billets or slabs as is shown in FIG. 8. This merely requires that the North pole piece 100 be spaced further from the South pole piece 102 to permit the reception of the billet or slab 104. In effect, the height of the magnet frame may be increased without changing the pole pieces.

Referring now to FIGS. 11 and 12, it will be seen that there is an apparatus for heating a stationary metal plate or slab 110 which is supported on an edge by means of a suitable support (not shown). The apparatus for heating the plate or slab 110 includes two sets 112, 114 of magnets. The set of magnets 112, which includes a plurality of individual magnets 116, is carried by an endless conveyor 118 that passes around a pair of horizontally disposed drums 120, 122 of which one of the drums is driven. The second magnet set 114 includes a plurality of individual magnets 124 which are carried by a second endless conveyor 126. The endless conveyor 126 also passes around a pair of vertically disposed drums 128, 130 of which one is driven. It is to be understood that the drums 128, 130 are to be driven in unison with the drums 120, 122. Further, it is to be understood that the spacing of the magnets 116 will be the same as the spacing of the magnets 124.

It will be seen that the conveyors 118, 126 have parallel runs with the parallel runs being on opposite sides of the plate 110 and parallel to the surfaces thereof. The magnets carried by the two conveyors are in alignment with one another as they move pass the plate 110 so as to be cooperative in the heating of the plate.

At this time it is pointed out that although the magnets utilized in conjunction with this invention have been generally described as being electromagnets requiring coils and a D.C. voltage source, it is feasible with modern day magnets to utilize permanent magnets.

Figure 15:
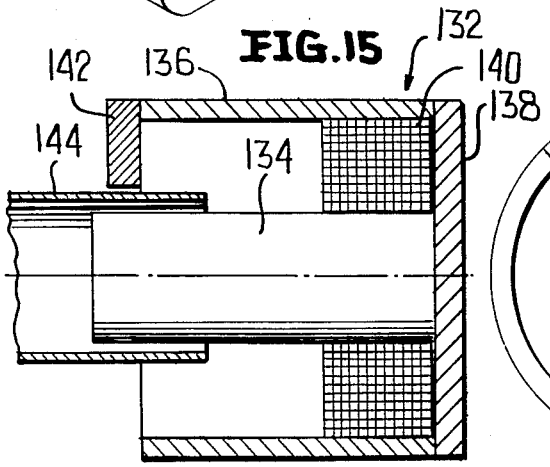
FIG. 15 is a fragmentary sectional view taken through a test apparatus for testing the efficiency of pole pieces.

It has been set forth above that in accordance with the invention, the number of poles should be restricted and the poles widely spaced. This is as a result of an investigation utilizing the apparatus shown in FIGS. 15–7. The apparatus, which is generally identified by the numeral 132 includes a center core 134 surrounded by a cylindrical frame member 136. The core is carried by an end plate 138 which is also connected to the cylindrical frame member 136.

A winding defining a coil 140 surrounds the core 134 adjacent the end piece 138.

The apparatus is constructed so that a pole piece 142 may be removably secured to the frame 136 remote from the end plate 138.

Figure 16:
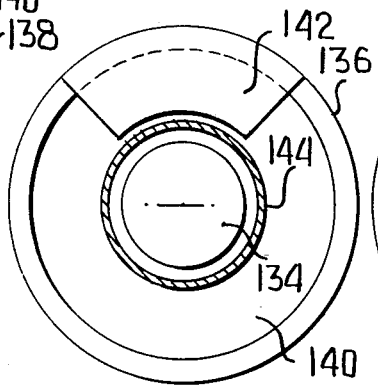
FIG. 16 is a schematic end view of the apparatus of FIG. 15 utilizing a single pole piece.
Figure 17:
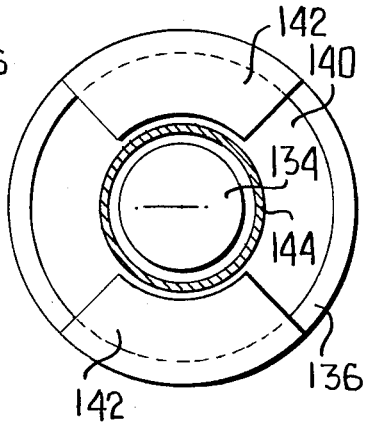
FIG. 17 is an end view similar to FIG. 16 showing the utilization of two pole pieces disposed in diametrically opposite relation.

The pole pieces 142 are provided in a variation of circumferential extent and thickness. In FIG. 16, the pole piece 142 extends one quarter of the diameter of the frame 136. In FIG. 17 there is illustrated two pole pieces 142 which are disposed in spaced diametrically opposite relation. There has been provided a third pole piece, not shown, wherein the pole piece would extend around three quarters of the circumferential extent of the frame member 136.

The pole pieces 142 have been provided in thicknesses of one-half inch, one inch, one and a half inch and two inch. A tubular member, such as the pipe 144, is telescoped over the end of the core 134 within the frame 136 and in overlapping relation to the one or more pole pieces 142. The pipe has a diameter of six inches.

Figure 18:
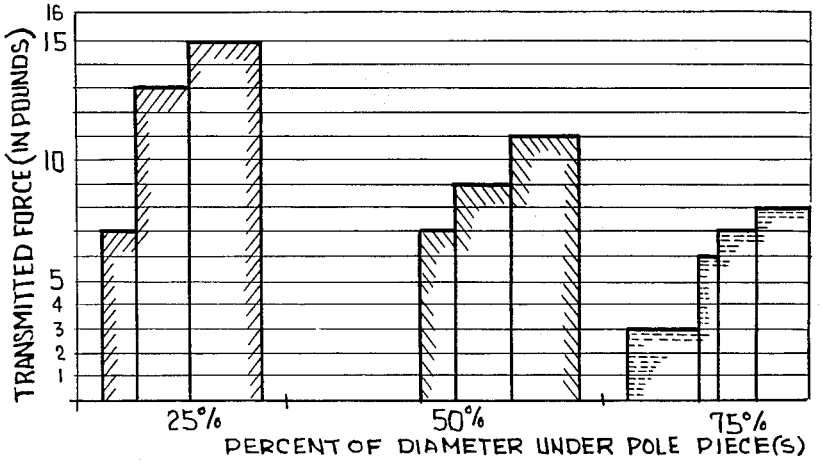
FIG. 18 is a graph showing the transmitted force with different numbers of pole pieces and different widths of pole pieces with the apparatus of FIG. 15.

Reference is now made to the graph of FIG. 18 wherein it is shown that the required force to rotate the pipe 144 was the greatest with a single pole piece and reduced when the circumferential extent of the pole piece(s) was increased. Further, it will be seen that the force required to rotate the pipe also increased with the increase in thickness of the pole piece.

It is particularly pointed out here that maximum heating of a uniform workpiece, such as a cylindrical member, slab or ingot, can be obtained when the depth of penetration of the induced electrical energy is on the order of one third of the thickness or diameter of the workpiece. In this way the heat generated by the induced electrical energy may uniformly heat the workpiece throughout its thickness.

It is to be appreciated that with the frequency of the induced current being on a low order and with a large depth of penetration the customary edge effect is eliminated and overheating of edges of strips, slabs, billets and the like is automatically prevented.

Figure 19:
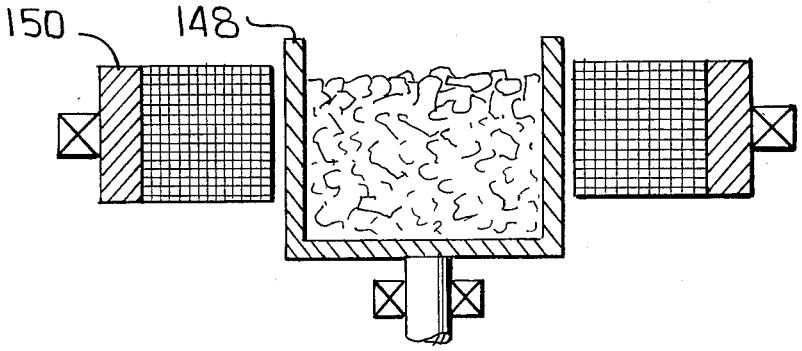
FIG. 19 is a schematic view wherein the billet is a crucible filled with metal to be melted.

While emphasis has been placed on the heating only of billets and other solid shapes, it must be appreciated that with the ability to have a large depth of penetration of the induced current, the billet could be formed as a crucible 148 filled with metal components which are not only to be heated, but heated to the melting stage. In such an arrangement, as shown in FIG. 19, the billet (crucible 148) will have a vertical axis. The electromagnet 150 would also have a vertical axis and should there be any tendency for the molten metal to be slung from the crucible, the electromagnet may be rotated or both the crucible and the electromagnet may be rotated but in opposite directions.

Inasmuch as the current is direct current, apparatus in accordance with this invention operates at unity power factor. Further, since the electrical energy is induced into the interior of the workpiece (armature) all $I^2R$ loss must appear as heat within the workpiece (armature).

Although only several preferred embodiments of the invention have been specifically illustrated and described herein, minor variations may be made in the invention without departing from the spirit and scope of the invention as defined by the appended claims.

I claim:

1. A method of magnetic flux induction heating an armature formed of strip shapes or the like, said method comprising the steps of forming a direct current generator including a direct current generator field and the armature, with the armature being a dead short and all electrical energy induced into the armature is directly converted into heat and effecting a pulsed induction of electrical energy into the armature at a frequency wherein there is a controlled depth of penetration of the armature by the induced electrical energy well beyond the surface of the armature wherein heat absorbed by the armature is primarily retained within the armature.

2. A method according to claim 1 wherein the pulsed induction of electrical energy into the armature is by cutting of the field through relative motion between the armature and the field.

3. A method according to claim 2 wherein said relative motion is solely linear.

4. A method according to claim 2 wherein said relative motion is solely rotational.

5. A method according to claim 2 wherein said cutting of said field is effected by varying the field intensity.

6. A method according to claim 1 wherein there is controlled penetration of electrical energy into said armature from the surface of said armature, said penetration varying in accordance with the rate of relative cutting of said field.

7. A method according to claim 1 wherein said direct current field effects operation at unity power factor.

8. A method according to claim 1 wherein said direct current field effects operation at unity power factor, and any $I^2R$ loss appears as heat in said armature.

9. A method according to claim 1 wherein any $I^2R$ loss appears as heat in said armature.

10. A method according to claim 1 wherein voltage of the electrical energy induced into said armature is on the order of 40 volts and less.

11. A method according to claim 1 wherein the frequency of the induced electrical energy is on the order of 60 hertz and less.

12. A method according to claim 1 wherein the direct current field is effected by permanent magnets.

13. A new article of manufacture comprising a magnetic flux induction heating apparatus including a metal workpiece to be heated in the form of a short circuited armature, said armature being positioned relative to a D.C. field, and means for effecting a pulsing induction of the electrical energy of said D.C. field into the armature as direct current.

14. An article of manufacture according to claim 13 wherein said means for effecting a pulsing induction of electrical energy are means for effecting a relative movement between said D.C. field and said armature for cutting of said D.C. field by said armature.

15. An article of manufacture according to claim 13 wherein said means for effecting a pulsing induction of electrical energy are means for effecting a relative linear movement between said D.C. field and said armature for cutting of said D.C. field by said armature.

16. An article of manufacture according to claim 13 wherein said means for effecting a pulsing induction of electrical energy are means for effecting a relative rotational movement between said D.C. field and said armature for cutting of said D.C. field by said armature.

17. An article of manufacture according to claim 13 wherein said D.C. field is provided by permanent magnetic means.

18. An article of manufacture according to claim 17 wherein the frequency of said pulsing induction is at a frequency on the order of 60 hertz and less to provide for induced current penetration of the workpiece on the order of one-third the thickness of the workpiece.

19. A new article of manufacture according to claim 16 wherein the armature is in the form of a large diameter elongated billet.

20. A new article of manufacture according to claim 16 wherein the armature is in the form of a coil of thin sheet metal.

21. A new article of manufacture according to claim 15 wherein the armature is in the form of an elongated member of sheet, web or slab type.

22. A new article of manufacture according to claim 15 wherein said armature is generally in the form of a plate, and the D.C. field is formed by fixed magnets positioned at one side of said armature and a series of moving magnets at the other side of said armature and moving parallel to said armature and said fixed magnets.

23. A new article of manufacture according to claim 22 wherein said fixed and moving magnets are permanent magnets, a loop type electromagnet encircles said fixed magnet, and said armature and the path of said moving magnets.

24. An article of manufacture according to claim 13 wherein said armature is in the form of a crucible having therein metal components to be melted.

25. A method according to claim 1 wherein the shape is in the form of a crucible having therein metal components, and the heating is to the extent that the metal components are melted.

26. A method according to claim 1 wherein the frequency and depth of penetration are such that overheating of edges of the shapes is prevented.

* * * * *